US007673766B1

(12) United States Patent
Yalon

(10) Patent No.: US 7,673,766 B1
(45) Date of Patent: Mar. 9, 2010

(54) RECEPTACLE WITH OFFSET FOCI OF WELL AND PERIMETER

(76) Inventor: Roland Yalon, 55 Tudor Ct., Springfield, NJ (US) 07081

( * ) Notice: Subject to any disclaimer, the term of this patent is extended or adjusted under 35 U.S.C. 154(b) by 1187 days.

(21) Appl. No.: 10/794,629

(22) Filed: Mar. 5, 2004

(51) Int. Cl.
*B65D 1/40* (2006.01)
*B65D 23/10* (2006.01)

(52) U.S. Cl. ..... 215/396; 215/12.1; 215/398; 220/669; 220/771

(58) Field of Classification Search ..... 215/12.1, 215/396–398, 382; 220/771, 603, 669, 675
See application file for complete search history.

(56) References Cited

U.S. PATENT DOCUMENTS 146,078 A * 12/1873 King ..... 215/398
307,297 A * 10/1884 Habenicht ..... 222/131
844,579 A * 2/1907 Clements ..... 215/382
904,237 A * 11/1908 Thessen ..... 220/758
D44,541 S * 8/1913 Richter ..... D7/536
1,519,034 A * 12/1924 Livingston ..... 215/12.1
3,100,054 A * 8/1963 Rubens ..... 220/574
3,794,370 A * 2/1974 Lockhart et al. ..... 294/31.2
4,263,734 A * 4/1981 Bradshaw ..... 40/324
4,676,385 A * 6/1987 Zimmermann ..... 215/12.1
5,267,669 A * 12/1993 Dixon et al. ..... 222/173
5,961,004 A * 10/1999 DeMars ..... 222/205
6,755,318 B2 * 6/2004 Burke et al. ..... 220/703
6,827,233 B1 * 12/2004 Scallate ..... 220/603
6,979,120 B1 * 12/2005 Wolfe ..... 374/162
7,080,752 B2 * 7/2006 Bergeron ..... 220/703

FOREIGN PATENT DOCUMENTS

EP 0358257 A1 * 3/1990

* cited by examiner

*Primary Examiner*—Sue A Weaver

(57) ABSTRACT

A receptacle for containing fluids constructed of a single wall wherein the foci of the well is offset from the foci of the perimeter, such that the resulting wall is of purposely differential thickness, to a point of maximal width. This may be of unitary construction from commonly used materials, utilizing the inherent insulating properties of the material selected, lowering manufacturing complexity and cost. In an application as a thermal container for beverages, the thickest aspect of the receptacle provides thermal insulation without interior or exterior insulating materials or internal air or vacuum chambers, and shifts the balance or center of gravity toward the holder, allowing more ease of lift. The specially shaped handle of the preferred embodiment, the present invention further enhances comfort and safety by reducing the potential for hand-burning, providing an ergonomic lifting grip which is beneficial to individuals with hand or wrist impairments.

4 Claims, 4 Drawing Sheets

RECEPTACLE WITH OFFSET FOCI OF WELL AND PERIMETER

FIELD OF THE INVENTION

This invention relates in general to containers for beverages and more particularly to insulated drinking cups, mugs and glasses.

BACKGROUND OF THE INVENTION

Drinking containers in modern times have been fabricated in both insulated and non-insulated constructions for use with beverages of various types. Since ancient times drinking cups for hot beverages such as tea have been designed with a handle external to the outer surface with two, or occasionally one, point(s) of attachment of sufficient dimension to support the weight of the container and maximum volume of liquid when lifted. Containers used for cold or room-temperature beverages, water and wine glasses for example, may have an insulating stem or no insulation at all. Insulated containers have the advantage of preserving the thermal properties of the beverage for longer than a conventional non-insulated mug or glass. They may have the further advantage of protecting the holder from discomfort, cold or even scalding, depending upon the specific design. Insulated containers have the disadvantages of manufacturing complexity, additional weight or size, or the constraint of having to incorporate non-conventional (e.g., plastics, not glass or ceramic) compounds, which may affect taste or "mouth feel," and/or to affix separate or cumbersome external insulators.

Notwithstanding these disadvantages, the desirability of insulated containers is evident from the popularity of so-called travel mugs. For simplicity of reference, insulated drinking containers of all types will be hereinafter may be termed insulated containers or "mugs," without limitation as to usage or design. Conventional glass or ceramic mugs of greater-than-usual wall thickness will have additional insulating properties due to dissipation of heat or preservation of cold by dint of the extra mass. These heavy mugs are generally more difficult and uncomfortable for the drinker to hold than an ordinary mug, particularly for persons with hand or wrist infirmities such as carpal-tunnel syndrome or arthritis. Thus, such persons and others may prefer the use of conventional, thinner-walled mugs for their comfort, with some additional risk to scalding or freezing. However, even conventional mugs with external handles have the property of placing the center of gravity considerably distal to the users' grasp, particularly when full of liquid, exerting an tortional pressure on the wrist and fingers.

Typically, there are three approaches to manufacturing an insulated mug. First is an inherently low thermally conducting material such as Styrofoam or similar, which is semi-porous, may lack rigidity and feels unlike household mugs. Second, an external insulator is affixed, permanently (e.g., foam handle or "grip-strip") or removably (e.g., cardboard collar for paper coffee containers). Third, a double-walled container in which the inner cavity is either a vacuum or filled with air or insulating material.

In the prior art, conventional and externally insulated mug-bodies have circular cross-sections with their single or double-walls of constant and uniform thickness. The conventional handle for single wall mug is curvilinear and attached at either the top or at both ends to the mug body, while the insulated double-wall mug has either a handle or a grip strip for convenience. Insulated mugs are the generally of a double-wall type of construction with the space between the walls either vacuum sealed for optimum insulation or not vacuum sealed for nominal insulation. Placement of a handle farther from the outer perimeter of the mug provides further insulating properties, but at an increasingly distal center of gravity, giving the mug an unbalanced feeling, placing more strain on the holder's wrist.

A recent example of the affixation of insulation in the prior art is Mott et al., U.S. Pat. No. 6,685,047, entitled Glass Beverage Container with Thermally Insulated Exterior Surface. Mott discloses a mug made of glass whereupon an insulating material such as latex or Neoprene is permanently bonded to the external handle. While Mott reduces thermal transfer, notably of cold, and is limited to glass, the disadvantages of weight and manufacturing complexity are not addressed. Another recent example is Kolowich, U.S. Pat. No. 6,634,417, Thermal Receptacle with Phase Change Material. Kolowich discloses a four-part structure encasing interstitial phase-change material wherein the structure of the side walls taper toward the top opening but are of uniform thickness at any horizontal cross-section, such that hot liquids are rapidly cooled, followed by release of the absorbed heat to maintain warmth. The receptacle disclosed in Kolowich functions to reduce temperature at first, for applications such as baby formula, requires expensive production equipment and special materials. The handle pictured in Kolowich is incidental. Kolowich does not address ergonomics. Another further example is Toida et al., U.S. Pat. No. 6,419,108, "Insulated Beverage Containing Device." Toida discloses various embodiments of a two-piece, separable container structure with an overlaying sleeve or ring, the interstitial space forming a vacuum, with an inner container of glass, plastic or ceramic, and an outer surface shielded from thermal transfer. No handle is disclosed. Toida reduces weight but requires fabrication, in effect, of two containers that function only in conjunction with their counterpart. Thus none of these recent examples from the prior art address manufacturing simplicity nor ergonomic function.

The manufacture of mugs of the double-wall type of construction requires several production and assembly steps. Additional complexity may be introduced in promotional or commercial settings where the mug is to have affixed trademark or advertising graphics due to the containers' generally circumferential outer wall. The first glance legibility of the decoration or printed material on conventional circular shaped mugs is limited by their inherent curvature field of vision.

The instant invention achieves its insulating and ergonomic properties through a purposefully differential wall thickness achieved by offsetting the foci of the interior fluid-holding chamber of the container from the foci of the entire receptacle. In the preferred embodiment, the foci of the well will be distal to the handle of the receptacle. In the preferred embodiment the resulting elliptical configuration facilitates graphics by the somewhat flattened shape of the receptacle body. Other objects and advantages will become apparent from the following specification taken in connection with the accompanying drawings.

DEFINITIONS

"Foci" is defined in singular construction as the point at the center of gravity.

"Foci of the well" is defined as the point at the center of gravity of the liquid encompassed by the well.

"Foci of the receptacle body" is defined as the point at the center of gravity of the entire receptacle body exclusive of the handle, if present.

"Receptacle body" means the entire structure of the present invention.

"Well" is defined as a chamber formed within the receptacle having an open upper end and closed lower end connected by a wall suitable for containing liquid.

SUMMARY OF THE INVENTION

The present invention is directed to single-wall drinking mug with a special cross-section and optional handle structure that significantly reduce the degree of thermal transfer. It achieves its insulating and ergonomic properties through purposefully offsetting the respective foci of the fluid-holding chamber of the receptacle, and foci of the receptacle body, irrespective of a handle. This offset results in a differential thickness with more mass, thus weight, at the point of maximal width where the user will grasp the receptacle. In the preferred embodiment, the point of maximal width is disposed proximally disposed to the handle.

The initial temperature of the liquids poured in the mug is maintained for longer period of time than with conventional single-wall mugs. The unique cross-sectional asymmetry induces an eccentricity which, in conjunction with the special handle structure of the preferred embodiment, acts to provide a better torsional lifting balance as well as a more comfortable overall grip control than conventional mugs with curvilinear handles. The cross-section provides a less convex visual surface than conventional circular mugs, and may therefore accommodate a wider first-glance field of vision surface for printing and graphic displays and facilitate their imprinting.

In accordance with the invention, the receptacle has an asymmetric cross-section that provides a tapering wall thickness which is greater where the user grasps the receptacle, or proximate to the handle of the preferred embodiment, gradually thinning distal thereto. The thickness of the cross-section is a function of the thermal conductivity of the material and the desired degree of insulation. In the preferred embodiment illustrated in the drawings of the present invention, the optional handle is attached at the top and bottom to the mug body and is further connected to it by curved flanges. A portion of the upper section of the handle is slanted for hand/thumb grip comfort. Other configurations of the handle, including without limitation a single point of attachment or non-angle orientation are within the scope of the present invention. Other configurations of the wall formed by various possible shapes of the perimeter and/or the well, for example a substantially triangular outer perimeter with an oval well, or a stepped or other non-gradual change of wall thickness, are contemplated by the present invention, so long as the foci of the well is offset from the foci of the receptacle body.

An object of the present invention is to simplify the manufacturing process of the disclosed receptacle.

Another object of the present invention is to permit utilization of a broad spectrum of materials.

Another object of the present invention is to employ the inherent thermal properties of any material utilized in the manufacture.

Another object of the present invention is to permit adaptation of various well and perimeter shapes.

Another object of the present invention is to enhance the comfort of drinking a beverage from a mug of the preferred embodiment.

Another object of the present invention is to assist the lifting of said mug, especially in aid of persons with various hand or wrist impairments.

Another object of the present invention is to facilitate the imprinting of graphics and promotional messages on the somewhat flattened outer surface of said mug.

DETAILED DESCRIPTION OF THE PREFERRED EMBODIMENT OF THE INVENTION

Figure 1:
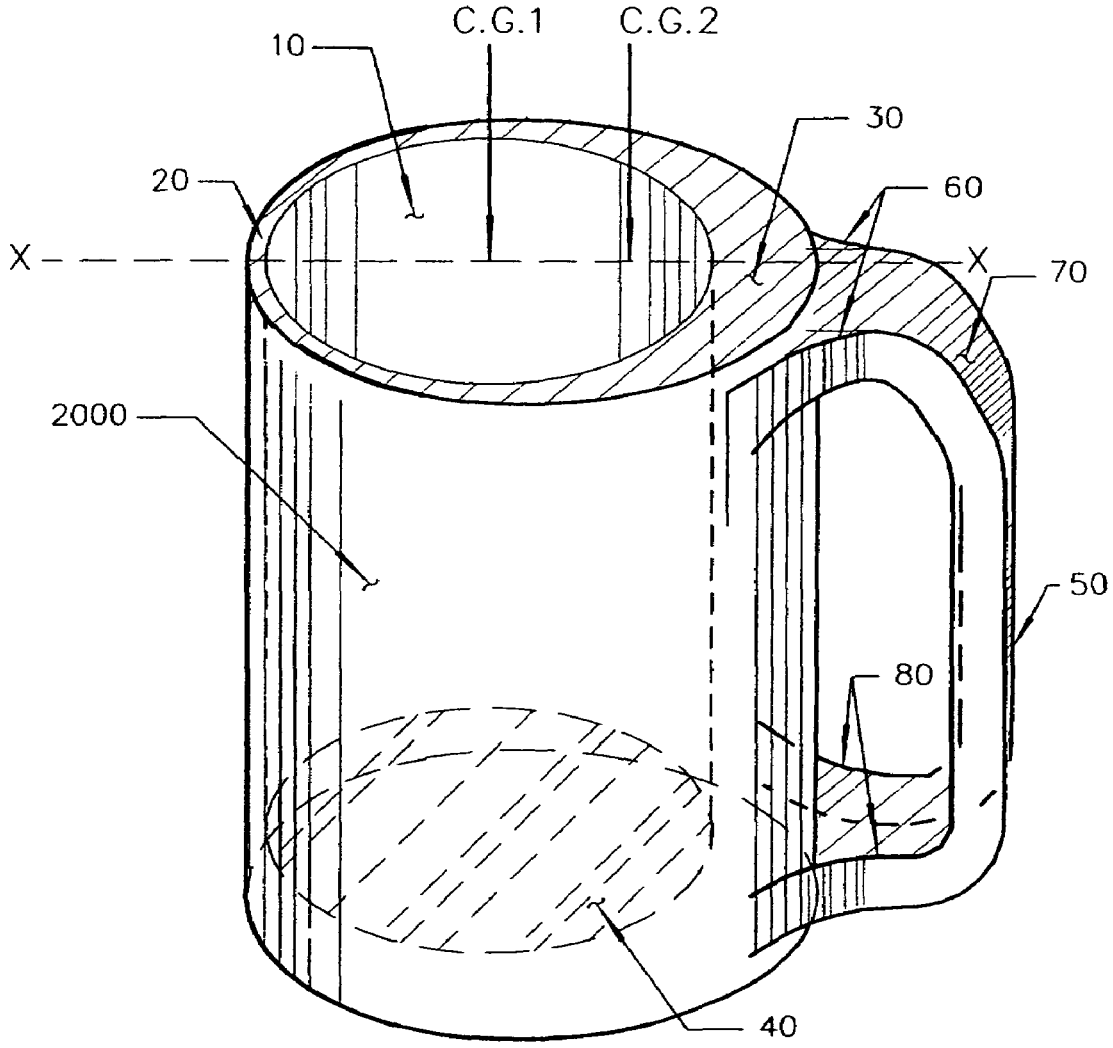
FIG. 1 is an isometric view of the preferred embodiment according to the present invention.
Figure 2:
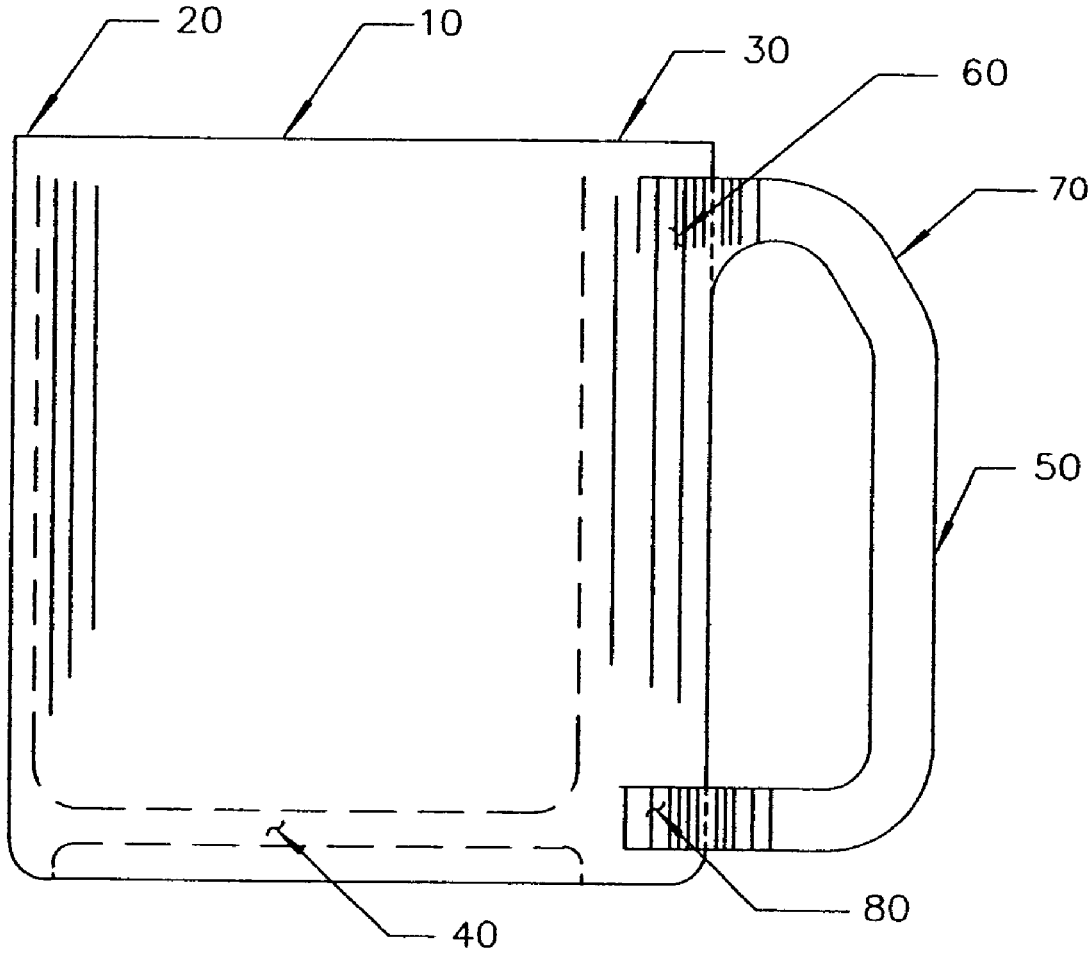
FIG. 2 is a front view of same.
Figure 3:
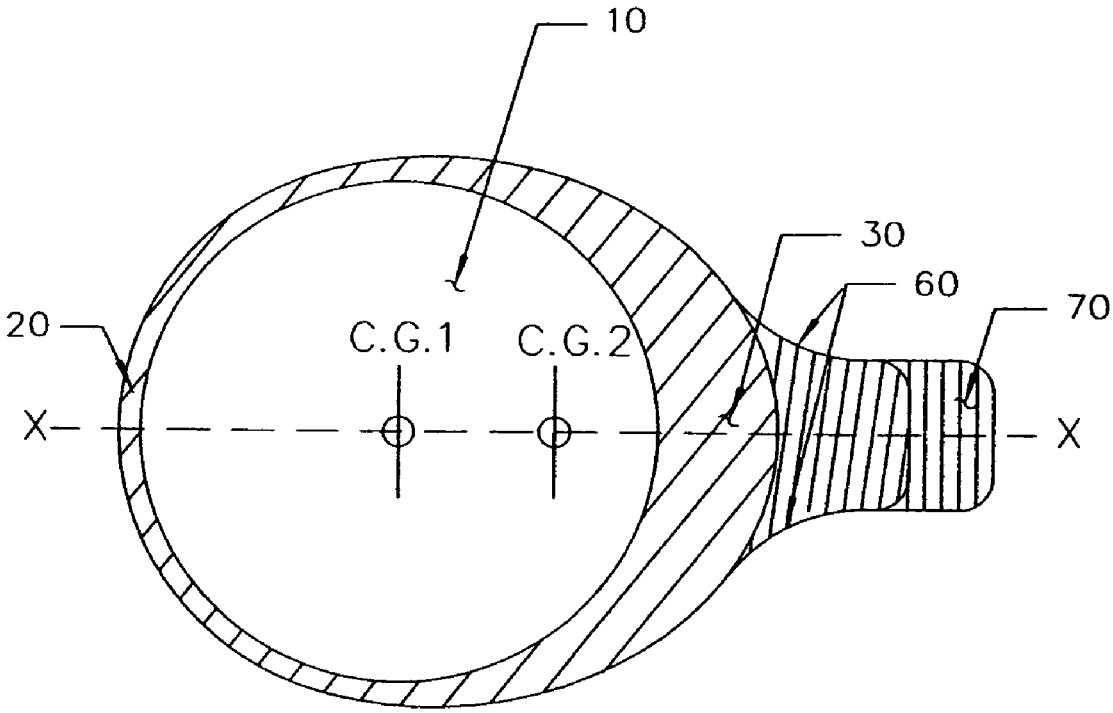
FIG. 3 is a top view of same.
Figure 4:
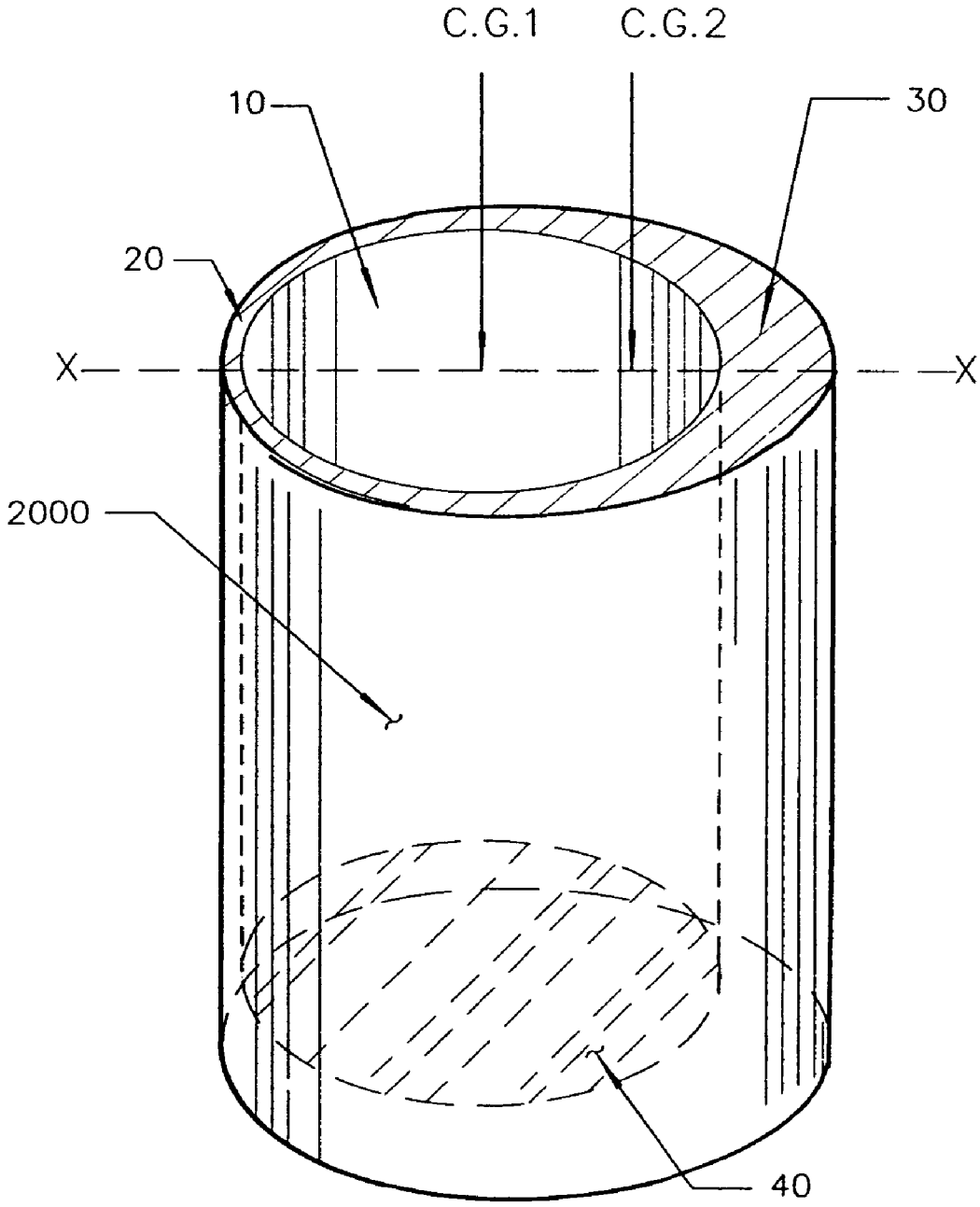
FIG. 4 is an isometric view of another embodiment of the present invention without a handle.

Referring to the drawings in more detail, which drawings form part of the specification and are to be read in conjunction therewith, FIGS. 1, 2 and 3 disclose different aspects of the preferred embodiment of the present invention as a mug for holding various types of liquids. FIG. 4 discloses another embodiment of the present invention without the handle 50 and substructures 60, 70 and 80. Like reference numerals are used to indicate like parts in the various views.

The receptacle consists of a mug body 2000 which forms a substantially circular well or chamber 10 for containment of fluids. The well 10 is open at the top and closed at the bottom 40. The perimeter wall 20 forms a substantially elliptical outer surface thickening in the direction of the handle 50 at the point of maximal width 30. The foci of the well 10 is offset from the foci of the receptacle body. The result of these offset foci is an asymmetrical wall configuration 30 which is thinner on one side and progressively thicker to the point of maximal distance from the foci of the well; i.e., the point of maximal width 30 of the perimeter wall 20. In the preferred embodiment, this graduation is continuous until the point of maximal width 30. This offset creates a eccentricity at the point of maximal width 30 which tends to shift the center of gravity toward the point of maximal width. The greater mass accruing at the point of maximal width 30 creates additional insulation to the extent inherent in the material used to fabricate the receptacle of the present invention. This configuration displaces the center of gravity toward the point of maximal width 30 where the holder may conveniently grasp the receptacle. This configuration minimizes wrist/finger strain.

In the preferred embodiment, a handle 50 is attached at the point of maximal thickness width 30. This disposition provides the maximum thermal insulation capacity of the material. It further displaces the relative offset center of gravity toward the handle 50 and, hence, toward the holder. The embodiment with a handle further minimizes wrist/finger strain while increasing the distance between the holder's fingers and the surface temperature of the receptacle's perimeter wall 20.

In accordance with the preferred embodiment of present invention the handle 50 is connected to the perimeter wall 20 of the receptacle body 2000 by a curved flange 60 at the top and to the both sides of the handle 50. The curved flange 60 descends to a slanted top portion 70 at the top of the handle 50 is shaped so as to enhance comfort and reduce wrist and hand strain by enabling a more natural disposition of the thumb during use as a drinking container or mug. The slanted top portion 70 facilitates thumb placement. The bottom portion of the handle 50 is also connected to the mug body 2000 by curved flanges 80. The lower curved flanges 80 of the preferred embodiment provide symmetry to the upper curved flanges 60 at approximately 45 degrees, further simplifying manufacturing and for aesthetics. Other embodiments of the present invention may omit curved flanges 60 or 80 such as where the handle 50 will have one point of attachment or where an alternate profile is employed. Other configurations of the handle 50, for example tapered or without the slanted top portion 70, are contemplated without departing from the novelty or utility of the present invention.

Although the foregoing description of the preferred embodiment of the present invention has shown, described and pointed out the fundamental novel features of the invention, it will be understood that certain features and subcombinations are of utility and may be employed without reference to other features and subcombinations. This is contemplated by and is within the scope of the claims. Since many possible embodiments may be made of the present invention without departing from the scope thereof, it is to be further understood that all matter herein set forth or shown in the accompanying drawings is to be interpreted as illustrative and not in a limiting sense.

I claim:

1. A solid-wall beverage receptacle fabricated of ceramic, glass, or medium to high-density plastic materials, comprising:

a body forming a well having an open upper end and a closed lower end and a perimeter wall connecting said upper end and said lower end, said body having a first center of gravity, said well having a second center of gravity, said second center of gravity being offset from said first center of gravity, said perimeter wall having width progressively expanding to a point of maximal thickness, such that said point of maximal thickness provides maximum insulation, wherein said point of maximum thickness has longitudinally disposed a handle upon the exterior of said perimeter wall proximal to said point of maximal thickness and whereby said handle is symmetrically situated along the axis defined by said first center of gravity of the body and said second center of gravity of the well, thereby mitigating thermal transfer and torsional stress induced by the mass of said beverage receptacle.

2. A beverage receptacle according to claim 1, said handle further comprising a top slanted portion forming a finger grip area mitigating the torsional stress induced by the mass of said beverage receptacle.

3. A beverage receptacle according to claim 1, said handle further comprising at least one upper curved flange rounding the upper attachment area of said handle to the open upper end of the beverage receptacle body, said upper curved flange forming a thumb grip area, whereby said upper curved flange proximally situated by area of maximum insulation mitigates thermal transfer and torsional stress induced by the mass of said beverage receptacle.

4. A beverage receptacle according to claim 1, said handle further comprising at least one lower curved flange rounding the lower attachment area of said handle to the closed lower end of the beverage receptacle body, said lower curved flange forming a finger and, or as well, a hand contact area, whereby said lower curved flange proximally situated by the area of maximum insulation mitigates thermal transfer and torsional stress induced by the mass of said beverage receptacle.

* * * * *